United States Patent [19]

Tarro

[11] 4,234,099

[45] Nov. 18, 1980

[54] CONTAINER WITH ATTACHED PULL TAB OPENING

[76] Inventor: Richard E. Tarro, 425 Broadway, Providence, R.I. 02909

[21] Appl. No.: 940,354

[22] Filed: Sep. 7, 1978

Related U.S. Application Data

[63] Continuation-in-part of Ser. No. 422,265, Dec. 6, 1973, abandoned, and a continuation-in-part of Ser. No. 603,590, Aug. 11, 1975, Pat. No. 4,008,823.

[51] Int. Cl.[3] ..... B65D 41/32

[52] U.S. Cl. ..... 220/269; 220/270; 220/336

[58] Field of Search ..... 220/260, 265, 266, 220, 220/268, 269, 359, 334, 336, 339; 229/7 R; 222/541; 206/807, 621; 215/250-256

[56] References Cited

U.S. PATENT DOCUMENTS

| | | | |
|---|---|---|---|
| 3,366,269 | 1/1968 | Shamski | 206/621 X |
| 3,441,167 | 4/1969 | Balocca | 220/271 |
| 3,783,996 | 1/1974 | Gerard et al. | 206/807 X |
| 3,813,000 | 5/1974 | Underwood | 220/269 |
| 3,908,856 | 9/1975 | Perry | 220/269 |
| 3,923,198 | 12/1975 | Brochman | 220/359 |
| 3,966,079 | 6/1976 | Kawamata | 220/359 X |

*Primary Examiner*—George T. Hall
*Attorney, Agent, or Firm*—Max Schwartz

[57] ABSTRACT

A container having a pull tab secured to a scored removable section. A pivot member tethers the removable section to the container top after the can is opened by pulling the tab. The removable section may be so constructed that it can be swung back over the opening and pressed back into place to reseal the container. An indicator may also be provided to show that the container has been opened and resealed. The pull tab may also be provided with a locking arrangement for releasably locking the pull tab to the container edge in either open or closed position. In some constructions, a second air vent opening may be provided and a single unitary pull tab member may open and close both openings simultaneously. This member is pivoted to the can top to tether it to the can but allow a pivotal action to open or close the openings. This form may also be provided with an indicator for showing the breaking of the seal.

18 Claims, 19 Drawing Figures

CONTAINER WITH ATTACHED PULL TAB OPENING

BACKGROUND OF THE INVENTION

This application constitutes a continuation in part of my copending application Ser. No. 422,265, now abandoned filed Dec. 6, 1973, and entitled Container With Attached Pull Tab Opener, and also a continuation in part of my copending application Ser. No. 603,590, filed Aug. 11, 1975, now U.S. Pat. No. 4,008,823, and entitled Container With Attached Pull Tab Opener, and a refiling of my application Ser. No. 744,196, filed Nov. 22, 1976, and entitled Container With Attached Pull Tab Opener, now abandoned.

More easy opening containers or cans provide a metal top with a scored portion which can be removed. A pull tab is attached to this portion so that when the tab is pulled, the scored portion is torn out and discarded leaving a pouring opening. In my application Ser. No. 422,265, a construction was shown in which the scored portion was pivotally tethered to the can top so that the small sharp piece would stay on the can and not become an ecological problem. In Ser. No. 603,590, a construction is shown in which the tab is releasably locked to the can edge to hold it out of the way or in place after resealing. However, there are problems in resealing various containers and some constructions show no indication or whether the can has been opened. Therefore, some indication is required, in addition to the resealing and locking constructions.

SUMMARY OF THE INVENTION

The present invention provides an improvement over the basic construction of the tethered pull tab and scored portion by rendering the scored portion resealable to close the can. This resealing action is in combination with the tethered construction. The present invention also provides means for indicating whether the can has been opened and resealed. Resealing may be provided by thickening the scored portion to allow it to be pressed back into the opening. The indicator may be provided by pasting a strip extending across the scored portion so that when the can is opened the strip will be broken. Other visual means may also be used to indicate the opening of the can.

DESCRIPTION OF THE INVENTION

Figure 1:
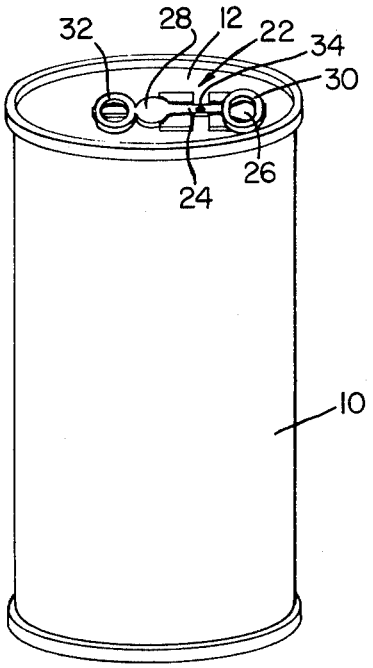
FIG. 1 is a perspective view of a resealable container having an opener of the present invention together with an indicator.

The present invention basically provides an easy opening container in which the portion of the metal that is removed to form the opening remains attached to the container and is not discarded independently thereof. In Ser. No. 603,590, a lock construction was added to hold the pull tab in place in either open or closed position. The present invention adds a resealable feature together with an indicator to show whether the can has been opened.

FIGS. 1 to 4, inclusive, show a resealable construction in a container having a separate air vent opening. Referring to the drawings, a conventional metal container or can 10 is provided with an annular metal top 12. The top 12 is provided with a scored section 14 which, when removed, leaves the pouring opening 16. In addition, the larger cans are also provided with a central opening 18 for an air vent, closed by the scored portion 20.

The opening device comprises a plastic elongated strip 22 having an elongated narrow body portion 24 and an integral broader end 26 which is bonded to the scored section 14. Adjacent the other end, the member 22 is provided with an enlarged area 28 which is bonded to the air vent closure 20. Each end of the member 22 is provided with a pull tab extending inwardly, the pull tab 30 at the outer end and the pull tab 32 at the inner end.

The feature of the device comprises a pivot rivet 34 extending through the member 22 and the top 12 to pivotally mount the member 22 on the top. Now, when the tabs 30 and 32 are manually grasped and pulled up and toward each other, the scored sections 14 and 20 will be removed with the member 22. The entire assembly can then be pivoted into the position shown in FIG. 3, clearing the openings 16 and 18. The assembly can then be twisted back into the position shown in FIG. 2 and the portions 14 and 20 pressed back into place to reseal the can.

Figure 2:
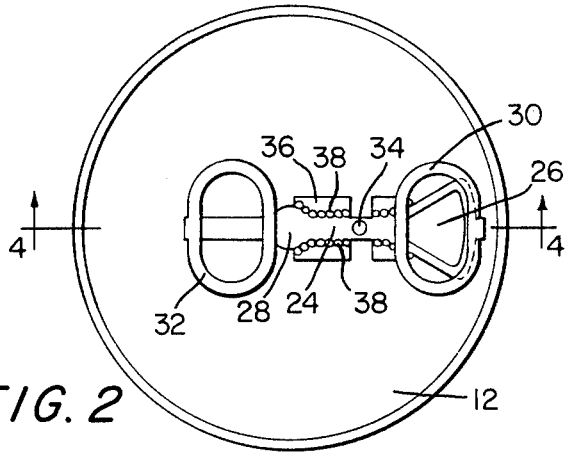
FIG. 2 is a top plan view of the container in FIG. 1.
Figure 3:
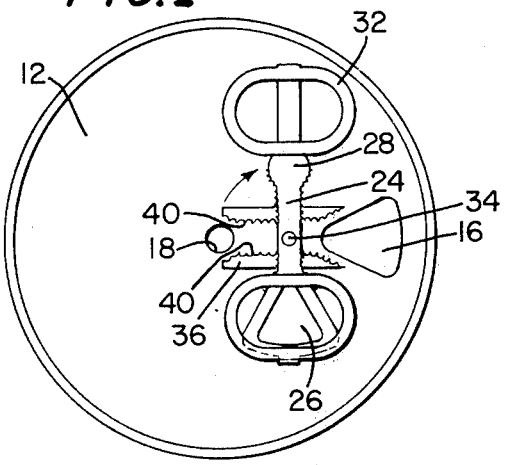
FIG. 3 is a view similar to FIG. 2 in open position.

The above construction thus eliminates any problems which may result from the loss of the member 22 which remains attached to the can after opening. To prevent tampering, an indicating device is illustrated in FIGS. 2 and 3 to show when the can has been opened. A strip of plastic 36 is bonded to the can top and the member 22 and is provided with perforations 38 along each side edge of the member 22. When the tabs are pulled upwardly to open the can, the plastic will tear along the perforations leaving the torn edges 40 as a telltale indicator that the can has been opened. Other forms of indicators may also be used.

Figure 5:
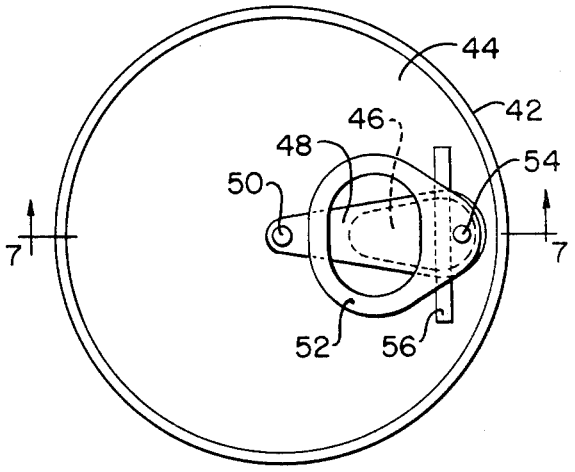
FIG. 5 is a top plan view of a single opening container with an indicating device of the present invention.
Figure 4:
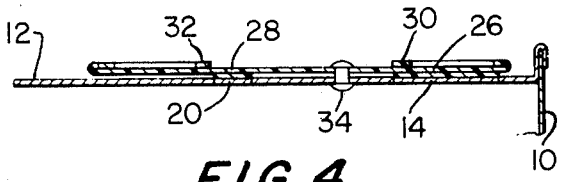
FIG. 4 is a longitudinal section taken on FIG. 2.
Figure 6:
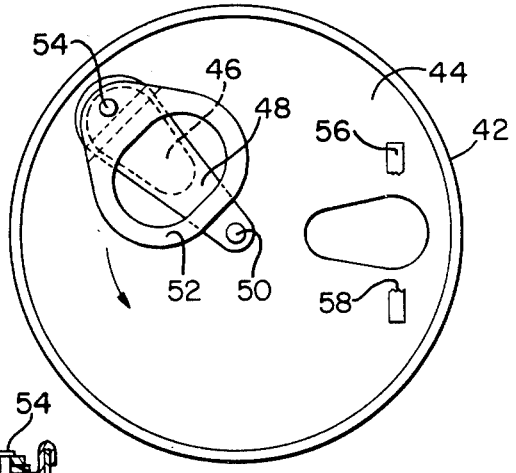
FIG. 6 is a view similar to FIG. 5 with the device in open position.
Figure 7:
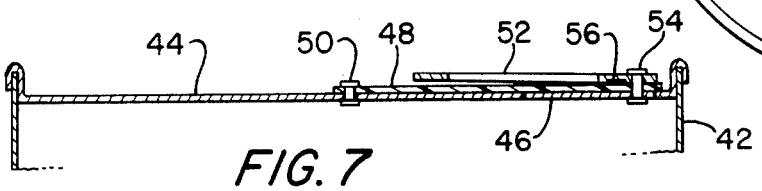
FIG. 7 is a section taken on line 7—7 on FIG. 5.

FIGS. 5, 6 and 7 illustrate the construction in a single opening resealable can. The can 42 is provided with the metal top 44 having the scored portion 46 for opening the can. An elongated pivot member 48 has its inner end riveted at 50 to the can top and extends across the top to completely cover the scored portion 46. The member 48 is bonded to the portion 46 and the pull tab 52 is attached by passing the rivet 54 through both the member 48 and the portion 46. When the tab is pulled to tear the portion 46 from the top, it remains attached to the member 48. It can thus be swung out of the way as shown in FIG. 6. It can also be swung back and snapped into the opening to reseal the can.

An indicator may also be used with this form to show that the can has been opened. A strip of paper or similar material 56 is glued or bonded to the top adjacent to the pull tab rivet 54 and extends transversely across the scored portion 46 beneath the tab 52, see FIG. 5. When the can has been opened, FIG. 6, the strip 56 is torn, leaving ragged edges 58. If desired, the material of the strip 56 may be of a different color on the outside than the inside to provide an immediate contrast. Also, a chemical can be used on the inside which will change color after the strip is torn. It should be noted that this indicator may be used with a single opening can, if desired, which is not resealable.

Figure 8:
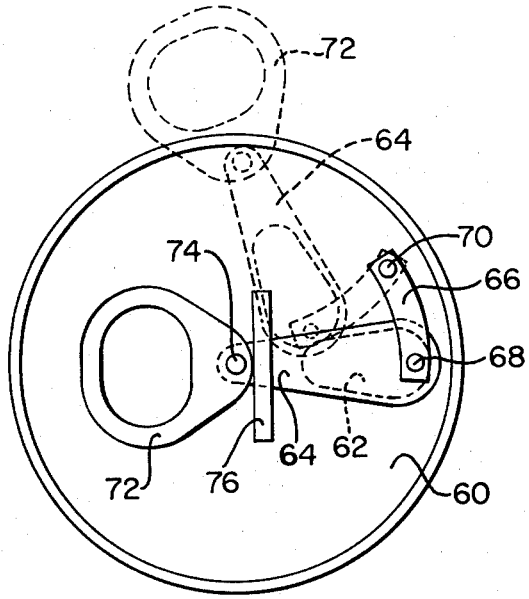
FIG. 8 is a view similar to FIG. 5 showing another form of pull tab opening with an indicator.

FIG. 8 is a view similar to FIG. 5 showing a resealable device and an indicator where the position of the tab is reversed so that the can is opened from the center outwardly. The can top 60 is provided with a scored portion 62. The plastic member 64 extends over and is bonded to the scored portion 62. An arcuate pivot member 66 is riveted at one end 68 to the scored portion 62 through the member 64. The other end of the pivot 66 is pivotally riveted at 70 to the top 60. The pull tab 72 is riveted to the inner end of the member 64 at 74.

Now, when the pull tab 72 is pulled upwardly, the scored portion 62 is torn out to open the can. The entire assembly can then be swung to one side as shown in the dotted lines to expose the opening. The assembly can then be swung back and pressed into the opening to reseal the can. An indicator may also be provided to show that the can has been opened. A strip 76 is bonded or glued to the top transversely across the member 64 adjacent the tab rivet 74. When the tab and member 64 is pulled upwardly to open the can, the strip 76 is torn to indicate the opening as in the form shown in FIG. 8.

Figure 9:
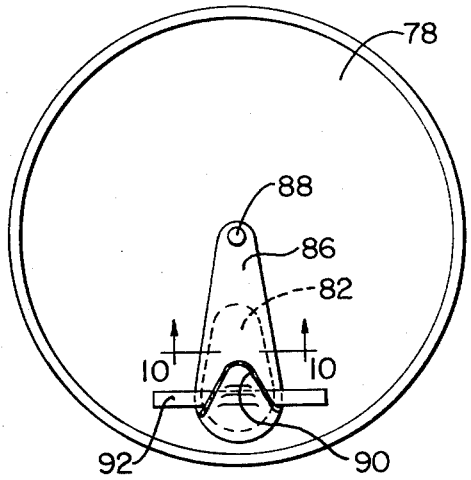
FIG. 9 is a view similar to FIG. 8 showing a form of resealable opener with an indicator.
Figure 10:
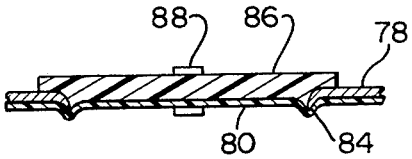
FIG. 10 is a section taken on line 10—10 on FIG. 9.

FIGS. 9 and 10 illustrate the principle applied to a container made in accordance with the patent to Ronci, Re. 26,524 issued Feb. 11, 1969. In this form, the can top 78 comprises the usual metal top and a thin layer of plastic 80 bonded to the underside of the top. The opening 82 in the metal top is stamped out to produce a sharp edged burr 84 extending inwardly. A thickened plastic member 86 is bonded to the portion 80 through the opening 82, and the rear end is pivotally riveted to the center of the can top at 88. A pull tab 90 is bonded to the member 86 adjacent the front end, FIG. 9. Now, when the tab is pulled, the plastic liner 80 will be torn against the edge of the burr 84 to reveal the opening. The assembly can then be swung to one side of the pivot 88. By swinging back to the position shown in FIG. 9, the thickened member 86 can be pressed back into the opening to reseal the can.

This form can also be provided with an indicator to prevent tampering and to show that the can has been opened. The indicator may be of the type heretofore illustrated in FIGS. 5 and 8. The indicator strip 92 is bonded transversely across the member 86 just behind the pull tab 90. Now, when the can is opened, the strip 92 will be torn to indicate the opening of the can.

Figure 11:
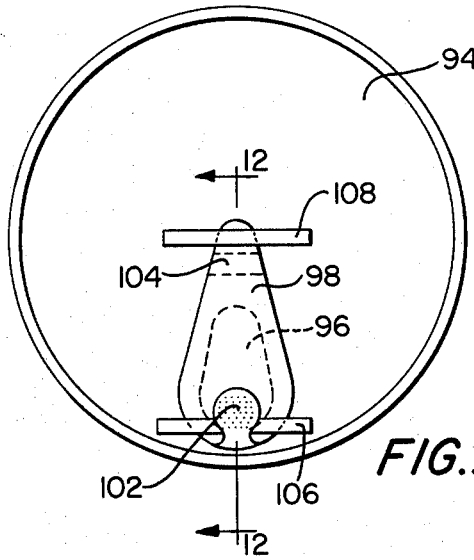
FIG. 11 is a view similar to FIG. 9 showing another form of resealable tab opening having an indicator.
Figure 12:
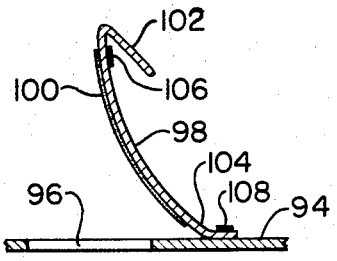
FIG. 12 is a section taken on line 12—12 on FIG. 11.

FIGS. 11 and 12 show a form of quick opening can in use with small juice or similar cans where there is a minimum of internal pressure. In this form, the can top 94 is provided with a conventional pouring opening 96. The closure is provided by a thin, flexible metal foil strip 98 having an adhesive coating 100 on its underside. The front end is provided with an integral tab portion 102 bent upwardly. The opening is normally closed by sticking the closure member 98 over the opening. To allow for resealing, a transverse strip 104, spaced from the inner end, is left without the adhesive 100. When the tab is pulled up to open the can, FIG. 12, the open area 104 will allow it to be swung up and still be stuck to the top at the inner end. The adhesive at the inner end may be permanent for this.

This form may require two indicators, since the member 98 can actually be removed at either end. At the front end, an indicating strip 106 extends transversely across just behind the tab 102. At the rear, the indicator strip 108 extends across the rear end past the open area 104. The strips 106 and 108 may be the same as those shown in FIG. 5.

Figure 13:
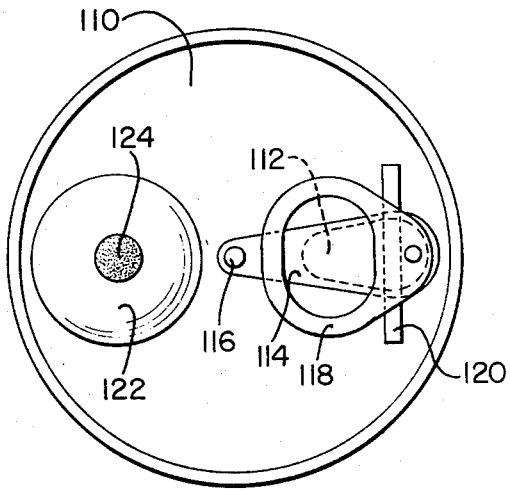
FIG. 13 is a view similar to FIG. 5 showing an additional indicating device added to the can top.

FIG. 13 illustrates an additional type of indicator particularly applicable where the can is under pressure, either internal or external (vacuum). For illustrative purposes, the indicator is shown on the type of can shown in FIG. 5, wherein the can top 110 is provided with the scored portion 112, closure member 114, pivotally mounted at 116 to the can top, pull tab 118, an indicator strip 120. As an additional indicator, the can top may be provided with an annular portion 122 which is pressed inwardly in a vacuum packed can and pressed outwardly in a pressurized can. The center of the portion 122 is provided with a chemical spot 124 which is similar to a stiff enamel. If the can is opened, the portion 122 will snap upwardly (vacuum) or inwardly (pressure) fracturing the spot 124 so that the spot of chemical will be splintered in appearance. If desired, the inner portion may be a different color form the outer for effect. Further, the inner portion of the chemical may be designed to oxidize when the surface is fractured to form a noticable color. This indicator may be used with or without the resealble feature.

Figure 14:
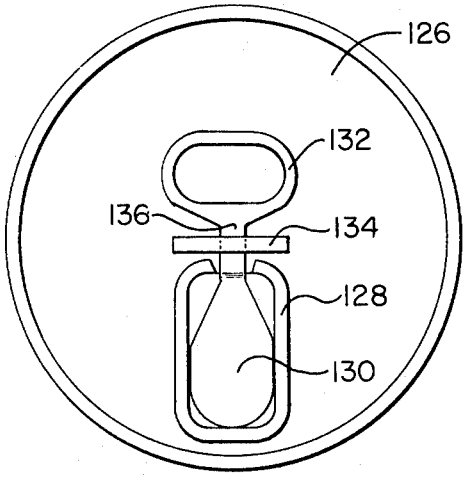
FIG. 14 is a view similar to FIG. 5 showing another form of opener with the indicator showing a resealing.

FIG. 14 illustrates the resealing indicator on a type of pull tab opener currently in use. Here the can top 126 is provided with a generally rectangular opening into which the pull tab assembly is mounted. This assembly comprises a frame portion 128 which is bonded and sealed to the top 126. The portion 128 is provided with a scored portion 130 having an integrally attached pull tab at the inner end 132. This form is usually not resealable, but can be constructed to be resealable. The indicator comprises a strip 134 bonded to the top 126 across the pull tab neck 136. When the tab is pulled to open the can, the strip 134 will be torn to indicate that the can has been opened.

Figure 15:
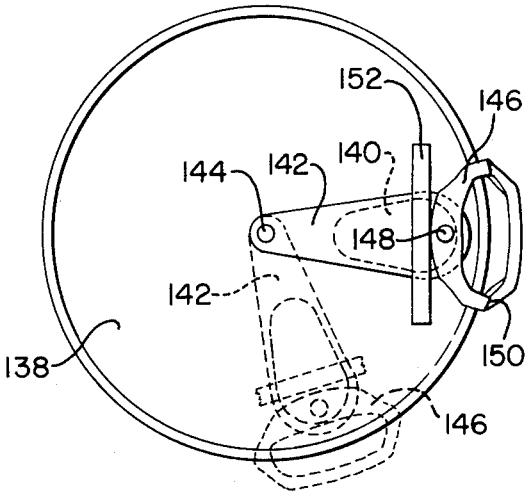
FIG. 15 is a view similar to FIG. 5 showing an opener with a locking device for resealing and an indicator for showing the opening.
Figure 17:
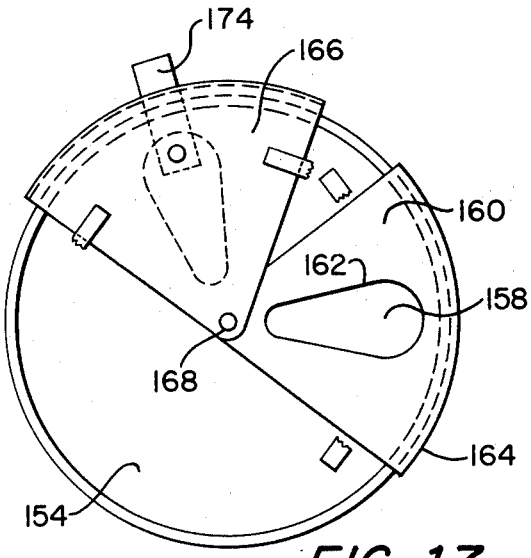
FIG. 17 is a view similar to FIG. 16, in open position.
Figure 16:
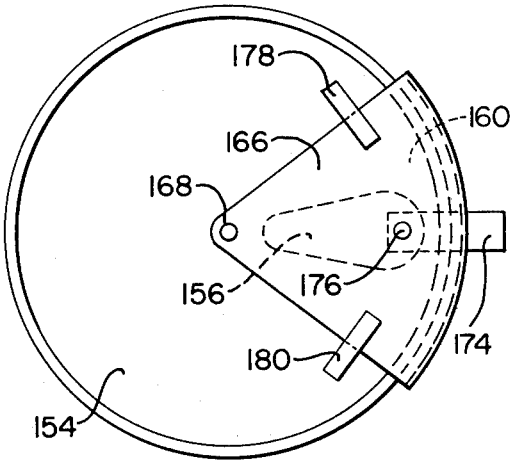
FIG. 16 is a top plan view of another form of container opener with a sanitary drinking feature and a lock and indicator.

FIG. 15 illustrates the construction of a resealable can as shown in my copending application Ser. No. 603,590. The can top 138 is provided with a scored portion 140 for opening the can. An elongated pivot member 142 has its inner end riveted at 144 to the top and extends across the top to completely cover the scored portion 140. The member 142 is bonded to the portion 140 and the pull tab 146 is attached by passing the rivet 148 through both members. When the tab is pulled to tear the portion 140 from the top, it remains attached to the member 142 and can be swung out of the way, dotted lines, to permit pouring or drinking. It can then be swung back and snapped into the opening to reseal the can. The tab 146 is sharply bend at 150 to snap over the edge of the can to hold it in place in resealing or in open position. If the member 142 is elastic, the tension will assist in holding the tab over the edge. This form, being resealable, should also be provided with an indicator. The strip 152 is bonded transversely across the member 142 adjacent the pull tab 146. When the pull tab is pulled upwardly to open the can, the strip 152 will be torn to indicate that the can has been opened.

The arrangement shown in FIGS. 16 to 19 is a modified version of the single opening resealable can providing a sanitary drinking area. The can top 154 is provided with a scored portion 156 for forming the opening 158. A generally triangular base plastic member 160 is bonded to the top of the can 154 and has a cut out portion 162 aligned with the portion 158 to expose the scored portion. At the edge, the member 160 thins down to form a plastic coating over the edge of the can at 164. When the can is used for drinking, the mouth will touch the plastic coat 164 rather than the metal of the can.

Figure 18:
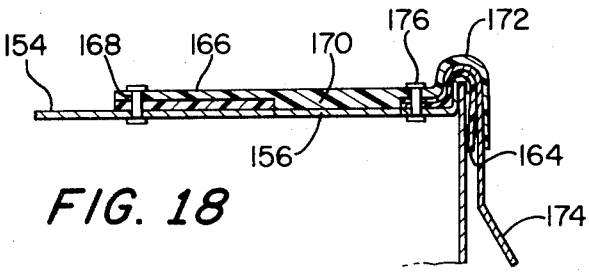
FIG. 18 is a longitudinal section of the device shown in FIG. 16.
Figure 19:
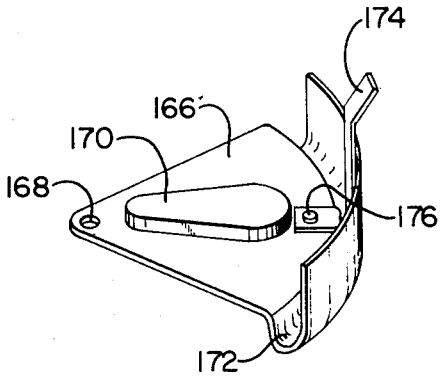
FIG. 19 is a perspective view of the closure member for the device shown in FIG. 16.

The closure member, FIG. 19, comprises a triangular member 166 attached at the apex 168 to the can top, FIG. 18. It is provided with a double thickness 170 shaped to fit into the opening 162 and to bond to the top of the scored portion 158. The member 166 has a thin inverted U-shaped edge 172 for snapping over the plastic edge 164 in closed position. The pull tab 174 is attached under the portion 166 to a rivet 176 which passes through the tab, scored portion, and member 166. If desired, the tab 174 can be imbedded in the member 166 for a more sanitary arrangement. The tab is also elongated to avoid interference with the six pack carton. When the tab is lifted, it will lift the member 166 and tear the portion 156 from the top. The assembly can be swung to one side, FIG. 17, and can be swung back and snapped in to reseal the can.

This form is also provided with an indicator to show that the can has been opened. Two strips 178 and 180 are bonded to the can top at each side edge of the member 166 to overlie the member 166 and the can top 154. When the tab is lifted to open the can, the strips 178 and 180 will both be torn to show that the can has been opened.

I have thus provided a quick opening can with means for resealing the can top and means for indicating the opening of the can to prevent tampering. The indicating means are separate from the resealing means so that the indicator can be used even when the can is not a resealable can. The concept is illustrated on different varieties of can openers to show that it can be readily applied easily to any type of can.

The devices are comparatively easy and inexpensive to manufacture and apply to the different can constructions. Other advantages of the present invention will be readily apparent to a person skilled in the art.

I claim:

1. A pull tab opener device for a container having a metal top comprising a scored portion outlining the opening of a generally oval shape aligning axially with a radius of the top, a pull tab attached to said scored portion adjacent the outer end thereof, means for pivotally attaching said scored portion to the top including a plastic strip having one end pivotally attached to the container top, the other end of said strip being bonded to the inner end of said scored portion, and means for returning said scored portion into the container opening to reclose the opening, said means comprising a thick portion at said scored portion formed by the thickness of said metal and of said plastic to allow said scored portion to be snapped back into the opening to reclose the container.

2. A pull tab opener as in claim 1, wherein the metal top is provided with a plastic liner beneath the top, said scored portion defining an opening to said plastic liner, whereby pulling on said pull tab will cause said liner to tear around said scored portion, said reclosure means comprising a thick member bonded to said liner through said scored opening, said member being pivotally attached to the top, whereby said member and liner may be snapped back into the opening to reclose the container.

3. A pull tab opener as in claim 1, wherein said scored portion defines an opening in the metal top, a flexible closure for said opening, said pull tab being integrally attached to one end of said closure, and an adhesive on the bottom of said closure for retaining said closure over said opening, one end of said closure extending beyond said opening to the top, whereby said tab may be pulled to flex said closure back from said scored opening, the extended end of said closure being retained on the top, said closure being flexible to return said closure to the top for reclosing.

4. A pull tab opener as in claim 1, wherein said attaching means comprises a plastic base bonded to the top, said base having an opening over said scored portion, said base extending over the edge of the container to form a sanitary drinking edge, a plastic closure member, the inner end of said closure member being riveted to the container top, said member having a thick portion entering said base opening and bonded to said scored portion, said pull tab being attached to said scored portion and said closure member, said closure member being pivoted about said rivet, whereby said thickened portion may be swung back over said opening to snap into said opening to reclose the container.

5. A pull tab opener as in claim 4, wherein said pull tab is provided with a portion bent over the edge of the container to extend below the edge, said bent portion snapping over the edge of the container to releasably retain said pull tab in open or closed position of the container.

6. A pull tab opener as in claim 1, wherein the metal top is provided with an inner second scored portion outlining an air vent opening, a second pull tab for said second scored portion, an elongated plastic member mounted over said scored portions and bonded thereto, said pull tabs being mounted on said scored portions through said plastic member, said member being adapted to be pushed into said openings to reclose the openings.

7. A pull tab opener as in claim 1, wherein the container top is provided with indicating means permanently attached to said top to show that the container has been opened.

8. A pull tab opener as in claim 2, wherein the container top is provided with indicating means permanently attached to said top to show that the container has been opened.

9. A pull tab opener as in claim 3, wherein the container top is provided with indicating means permanently attached to said top to show that the container has been opened.

10. A pull tab opener as in claim 4, wherein the container top is provided with indicating means permanently attached to said top to show that the container has been opened.

11. A pull tab opener as in claim 5, wherein the container top is provided with indicating means permanently attached to said top to show that the container has been opened.

12. A pull tab opener as in claim 7, wherein said indicating means comprises a strip of material bonded to the top transversely of said scored portion, whereby said material will be torn when said scored portion is removed.

13. A pull tab opener as in claim 8, wherein said indicating means comprises a strip of material bonded to the top transversely of said scored portion, whereby said material will be torn when said scored portion is removed.

14. A pull tab opener as in claim 9, wherein said indicating means comprises a strip of material bonded to the top transversely of said scored portion, whereby said material will be torn when said scored portion is removed.

15. A pull tab opener as in claim 10, wherein said indicating means comprises a plurality of strips of material bonded to the top and overlying said closure member, whereby said material will be torn when said closure member is pulled up to open the container.

16. A pull tab opener as in claim 11, wherein said indicating means comprises a plurality of strips of material bonded to the top and overlying said closure member, whereby said material will be torn when said closure member is pulled up to open the container.

17. A pull tab opener as in claim 7, wherein said indicating means comprises a spot of material hardened to the top, whereby said spot will crack when said container is opened.

18. The pull tab opener as in claim 17, wherein the top is biased from the horizontal by either internal or external pressure, said spot fracturing when the top returns to the horizontal when the container is opened.

* * * * *